US009840344B2

(12) United States Patent
Grabher

(10) Patent No.: US 9,840,344 B2
(45) Date of Patent: Dec. 12, 2017

(54) METHOD AND DEVICE FOR PRODUCTION OF CAN WITH FOLD LINES

(71) Applicant: Werner Grabher, Balgach (CH)

(72) Inventor: Werner Grabher, Balgach (CH)

( * ) Notice: Subject to any disclaimer, the term of this patent is extended or adjusted under 35 U.S.C. 154(b) by 711 days.

(21) Appl. No.: 14/261,159

(22) Filed: Apr. 24, 2014

(65) Prior Publication Data

US 2014/0318082 A1 Oct. 30, 2014

Related U.S. Application Data

(60) Division of application No. 12/779,273, filed on May 13, 2010, which is a continuation of application No. 10/512,242, filed as application No. PCT/EP03/03921 on Apr. 15, 2003, now abandoned.

(30) Foreign Application Priority Data

Apr. 24, 2002 (CH) ..... 0706/02

(51) Int. Cl.

| | |
|---|---|
| ***B65B 3/02*** | (2006.01) |
| ***B65D 3/08*** | (2006.01) |
| ***B65D 8/00*** | (2006.01) |
| ***B21D 51/26*** | (2006.01) |
| ***B65B 3/04*** | (2006.01) |
| *B31B 120/30* | (2017.01) |
| *B31B 105/00* | (2017.01) |

(52) U.S. Cl.

CPC ..... *B65B 3/027* (2013.01); *B21D 51/2646* (2013.01); *B21D 51/2661* (2013.01); *B65B 3/04* (2013.01); *B65D 3/08* (2013.01); *B65D 15/04* (2013.01); *B31B 2105/00* (2017.08); *B31B 2120/30* (2017.08); *B31B 2217/0007* (2013.01)

(58) Field of Classification Search

CPC ..... B21D 51/2646; B21D 51/2661; B31B 2217/0007; B65B 3/027; B65B 3/04; B65D 3/08; B65D 15/04

USPC ..... 53/452, 563; 493/180; 220/669; 413/2, 413/6, 7

See application file for complete search history.

(56) References Cited

U.S. PATENT DOCUMENTS

| | | | | |
|---|---|---|---|---|
| 2,293,142 A * | 8/1942 | Ogden Johnson | B31B 17/00 229/4.5 |
| 2,339,896 A * | 1/1944 | Waters | B29C 65/18 141/114 |
| 2,367,705 A | 1/1945 | Wansker | |
| 2,989,219 A * | 6/1961 | Overton | B65D 15/04 229/5.7 |
| 3,103,857 A * | 9/1963 | William Geisler | B31B 49/00 118/243 |
| 3,402,876 A | 9/1968 | Kuchenbecker | |

(Continued)

FOREIGN PATENT DOCUMENTS

EP 0 825 125 A1 2/1998

*Primary Examiner* — Andrew M Tecco
*Assistant Examiner* — Valentin Neacsu
(74) *Attorney, Agent, or Firm* — Rothwell, Figg, Ernst & Manbeck, P.C.

(57) ABSTRACT

A can, and device and method for producing same, includes two circular end elements forming a base and lid. The can further includes a sleeve which has fold lines forming edges, the can sleeve having a circular cross-sectional area at both ends and a polygonal-sectional area in its central region. The polygonal cross-sectional area in the central region is at most decagonal.

11 Claims, 5 Drawing Sheets

(56) References Cited

U.S. PATENT DOCUMENTS

| | | | | | |
|---|---|---|---|---|---|
| 3,670,946 | A * | 6/1972 | Croley | B65D 5/68 | 229/4.5 |
| 3,712,530 | A * | 1/1973 | Croley | B65D 15/06 | 229/4.5 |
| 3,937,392 | A * | 2/1976 | Swisher | B65D 5/12 | 220/320 |
| 4,042,164 | A * | 8/1977 | Croley | B65D 5/12 | 229/108 |
| 4,057,444 | A * | 11/1977 | Prot | B31B 17/00 | 156/242 |
| 4,185,749 | A * | 1/1980 | Vartia | B21C 23/20 | 220/669 |
| 4,204,462 | A | 5/1980 | Richards et al. | | |
| 4,338,765 | A * | 7/1982 | Ohmori | B65B 3/00 | 53/289 |
| 4,347,934 | A * | 9/1982 | Goodman | B31B 7/00 | 206/525 |
| 4,692,132 | A * | 9/1987 | Ikushima | B65D 3/22 | 220/619 |
| 4,742,951 | A * | 5/1988 | Kelly | B65D 77/06 | 229/109 |
| 4,813,862 | A * | 3/1989 | Bowers | B65D 85/78 | 222/107 |
| 5,348,186 | A * | 9/1994 | Baker | B65D 5/14 | 222/105 |
| 5,645,190 | A * | 7/1997 | Goldberg | B65D 1/165 | 220/674 |
| 5,778,639 | A * | 7/1998 | Sireix | B31B 17/00 | 53/289 |
| 2001/0002677 | A1 * | 6/2001 | Grabher | B31B 17/00 | 229/4.5 |

* cited by examiner

METHOD AND DEVICE FOR PRODUCTION OF CAN WITH FOLD LINES

CROSS-REFERENCE TO RELATED APPLICATION

This application is a divisional of U.S. patent application Ser. No. 12/779,273, filed May 13, 2010, which is a continuation of U.S. patent application Ser. No. 10/512,242, filed Oct. 22, 2004, which is a National Phase of International Application Serial No. PCT/EP03/03921, filed Apr. 15, 2003 and also claims the benefit of Switzerland Application No. 0706/02, filed Apr. 24 2002, each of which is incorporated by reference in their entirety.

FIELD OF INVENTION

The invention relates to the field of cans with fold lines and devices for their production.

BACKGROUND OF THE ART

It is known that the transport of empty cans to the place of filling and the stocking of empty cans at the place of filling entail a significant effort. This logistical effort can be dramatically reduced if the can is manufactured at the place of filling.

The publication DE-A1-31 10 697 discloses a packaging container in which a three-dimensional sleeve is shaped from a packaging material blank at the filling plant. An accuracy of the butt joint or of the overlap in the region of the two open ends of the sleeve, which accuracy is required for the subsequent tightness of the container, can be achieved only with difficulty; on the other hand, cylindrical cans having a sleeve obtained from a flat cardboard sheet do not have the stable grip required by the user.

WO 98/03403 discloses polygonal cans having externally prefabricated can sleeves. However, this can concept which is advantageous in particular for medium-sized and smaller series has not become established in practice. Firstly, polygonal end pieces are expensive to process and to seal.

A drum-shaped container having a multiplicity of vertical fold lines in the sleeve is described in U.S. Pat. No. 3,712,530. Although such a container fulfils the desire for a small volume of the collapsed sleeve, it uses very complicated lid constructions to enable the drum to be rolled and does not improve the rigidity compared with a sleeve free of fold lines.

A further possibility of a drum-like container having a polygonal cross-section and circular base and lid is described in U.S. Pat. No. 2,989,219, the object of the invention disclosed therein being primarily to provide a safe lid construction suitable for large containers.

U.S. Pat. No. 5,778,639 in turn describes a method and a device by means of which a round base can be imposed on packaging having a noncircular cross-section.

SUMMARY OF THE INVENTION

It is the object of the invention to eliminate the deficiencies of the prior art. Thus, it is intended, inter alia, to propose a can in which the cost for the transport and the storage of the empty cans can be kept low, the use of commercial round lids is permitted and the rigidity or stability of grip of the sleeve of the filled can is improved. This object is achieved for the first time in a surprising manner.

Further advantageous and alternative developments of the invention, in particular a method and a device for the production of the can according to the invention, are described herein.

When the term circular is used in association with the invention, it is also intended to be understood as meaning shapes deviating slightly from the circular shape, for example ellipses having semiaxes differing only slightly from one another.

Cans having circular end pieces have a number of advantages. Firstly, standardized, circular end elements or sealing elements, but especially existing sealing machines, can be used. Secondly, it is known in principle that a circular opening is in principle technically less complicated to seal.

When a can is gripped, compressive forces directed substantially perpendicularly to the can axis are exerted on the can sleeve, and the can has to withstand said forces. However, if the can consists of two circular end pieces and a sleeve which is produced from a piece of a flat paper and/or cardboard.

In a manner known per se, on perpendicular application of a compressive force, a sheet-like member no longer has dimensional stability above a certain magnitude of the force. Thus, for example, bends or dents occur. In contrast, when a sheet-like member is provided with edges, its dimensional stability improves considerably. Bends and dents occur only at substantially greater compressive forces.

It is also known that the bending energy required for bending a sheet-like member produced in particular from a paper and/or cardboard composite is substantially reduced by providing a fold line. The bending of the member therefore preferably takes place at the fold line, with the result that an edge is automatically formed in the region of the fold line.

The invention is based on the discovery that a sleeve which is closed all round and which is produced from a paper and/or cardboard composite and connects two circular end elements to one another automatically forms edges if the can sleeve is provided with fold lines perpendicular to the circumferential direction. The individual segments between the fold lines arch inwards owing to the circular cross-sectional area imposed by the end elements at both ends, and the edges formed by the fold lines arch outwards. Consequently, the stability of the can, in particular the region where it is gripped, is decisively improved.

With a can according to the invention, the conventional wall thicknesses of a sheet-like paper and/or cardboard composite can be reduced by more than half. A light, environmentally friendly and stable can which involves little energy consumption and can be produced on conventional standardized machines with standardized lids is permitted. The greatly reduced wall thicknesses also have advantages in the case of optional gas-tight joining of the can sleeve to the two end elements.

The improved rigidity or stability of grip of the can according to the invention could be confirmed by measurements. It was found that, in the case of a standard can size having a height of 120 mm and a diameter of 73 mm, a maximum increase can be achieved in the case of hexagonal and octagonal can sleeves, while both in the case of can sleeves having only 2 or 4 fold lines and in the case of those having 10 or 12 fold lines and hence edges, the force-displacement curves are already close to the round can.

In the method according to the invention, for example, a polygonally prefolded can sleeve closed all round is drawn onto a circular intermediate shaping mandrel. As a result, the shape of a cylindrical sleeve is imposed on the polygonally prefolded can sleeve. The end can be connected to a standardized circular end element without problems on a conventional machine.

BRIEF DESCRIPTION OF THE DRAWINGS

The invention is described in more detail below with reference to the figures of the drawing, using a hexagonal can sleeve as an example. Identical parts in different embodiments which perform the same functions are provided below with identical designations and reference numerals. In the drawing.

DETAILED DESCRIPTION OF THE INVENTION

Figure 1:
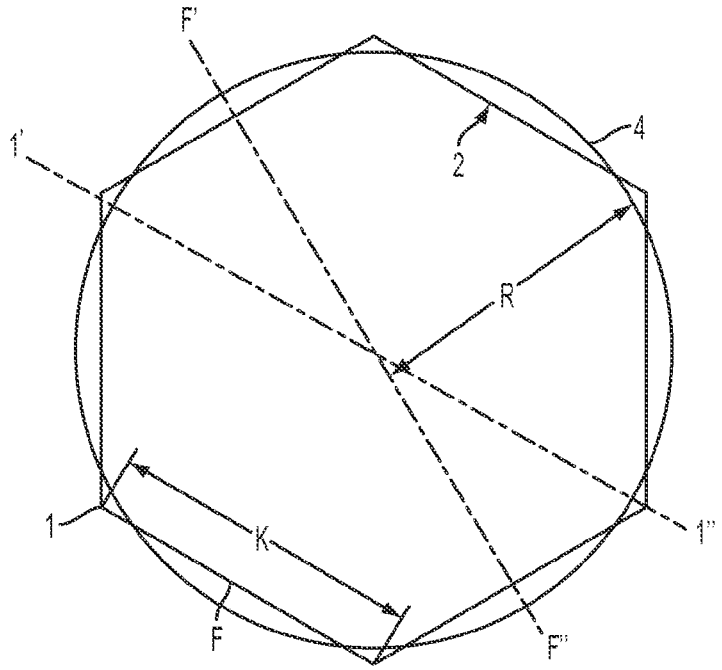
FIG. 1 shows a plan view of the lid placed on the opening of a hexagonal sleeve which has been folded out.

According to FIG. 1, a commercial, circular end element 4, e.g. a lid, having the radius R, rests concentrically on an unfolded, hexagonal can sleeve 2. The edge length K of the sleeve is $2R\pi/6$. If the sleeve 2 is made circular at its opening, for example by applying an external circular shape (intermediate shaping jaws 6 in FIG. 5), so that the lid 4 can be inserted and/or, for example, rolled over the sleeve edge (FIG. 4, lower part), the edges 1 in the region of the lid 4 are drawn inwards when the can is closed.

Figure 2A:
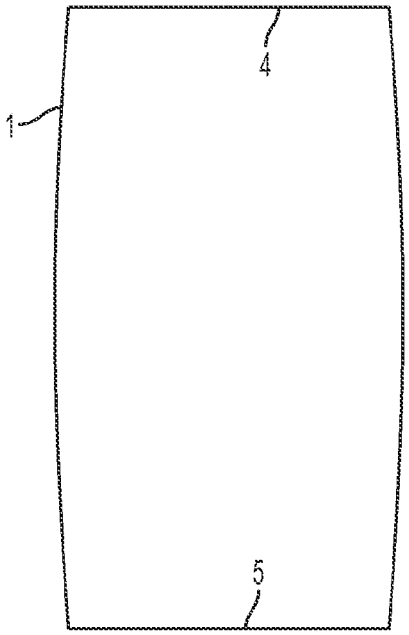
FIGS. 2*a* and *b* each show a longitudinal section along the line 1'-1" and F'-F", respectively, from FIG. 1.
Figure 2B:
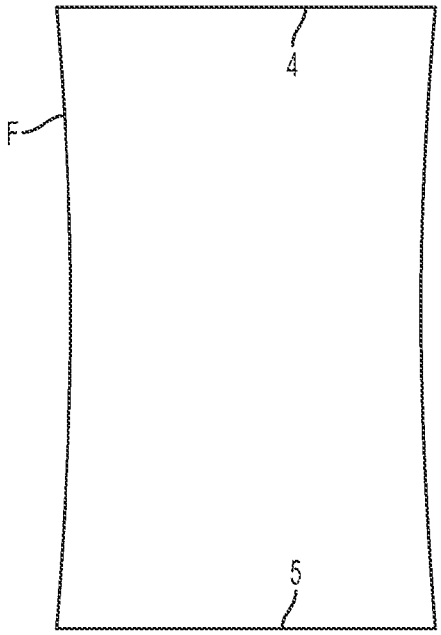

This inevitably causes the edges 1 to project slightly outwards in the middle of the can height between the two lids 4, 5, i.e. to be dished slightly outwards in their contour, axially relative to the can (FIG. 2*a*). In contrast, the six prism surfaces F of the sleeve 2 in the region of the two lids 4, 5 are each pressed outwards, which inevitably results in the surfaces F in the middle of the can height between the two lids 4, 5 projecting slightly inwards, i.e. arching slightly inwards in their contour, axially relative to the can, and hence being prestressed (FIG. 2*b*). Both result in an unexpectedly great increase in the rigidity and stability of grip of the can.

Figure 3:
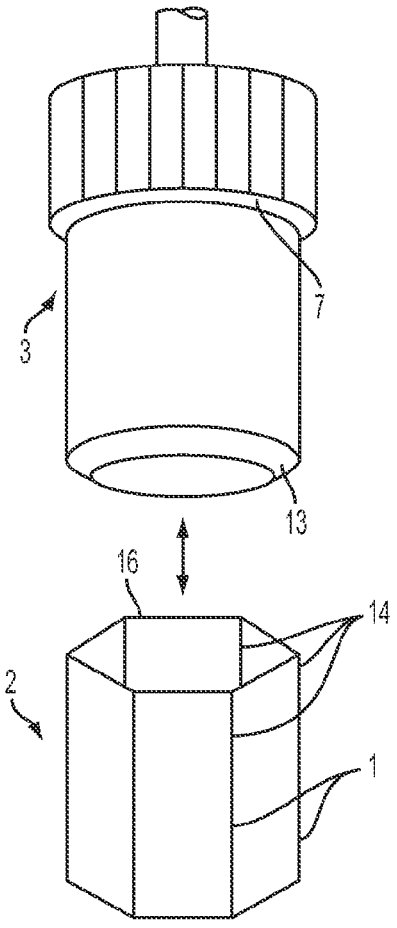
FIG. 3 shows a cylindrical intermediate shaping mandrel perpendicularly above an aligned can sleeve having a hexagonal base shape, in oblique view.

FIG. 3 shows an intermediate shaping mandrel 3, which is positioned perpendicularly above a can sleeve 2. The prefabricated can sleeve 2 which is closed all round and provided with fold lines is removed from a stack of flattened can sleeves and set up as a hexagonal prism by pushing together two opposite fold edges. In this embodiment, the can sleeve 2 has six fold lines 14 oriented parallel to the longitudinal axis of the can sleeve 2. When the can sleeve 2 has been set up, the fold lines 14 form edges 1 over their entire length. Two edges of the piece of the paper and/or cardboard composite of which the can sleeve 2 consists are adjoined so as to overlap one another in the overlap region 16. The overlap region 16 is compressed to give the single layer thickness of the paper and/or cardboard composite. A prefabricated can sleeve could, however, equally well have two abutting edges which are joined to one another in a manner known per se by means of a joining strip.

Here, the intermediate shaping mandrel 3 has a cylindrical base shape. That end face of the intermediate shaping mandrel 3 which points towards the can sleeve 2 has a feed bevel 13 for the can sleeve 2. Here, a shaping means 7, by means of which a can sleeve 2 can optionally be preshaped for further steps of the method, is arranged at the bottom of the intermediate mandrel 3.

The can sleeve 2 is drawn onto the intermediate shaping mandrel 3 by pressing the latter against the can sleeve 3. Intermediate shaping jaws 6 shown in FIG. 5 support the can sleeve 2 laterally in the end region at the other end.

Figure 4:
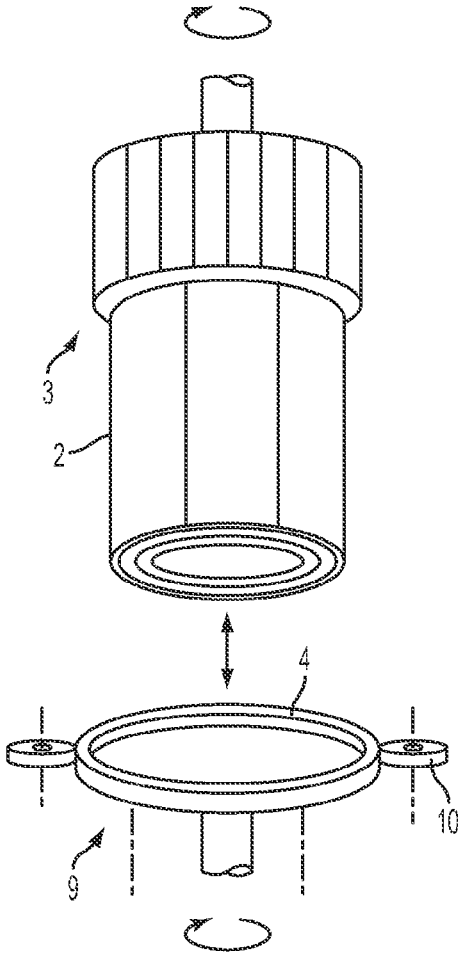
FIG. 4 shows the can sleeve drawn onto the intermediate shaping mandrel, above a sealing means, in oblique view.

FIG. 4 shows the can sleeve from FIG. 3 drawn onto the intermediate shaping mandrel 3, above a sealing means 9 equipped with a first end element, e.g. lid, 4. The can sleeve 2 drawn onto the intermediate shaping mandrel 3 then likewise has a cylindrical shape. The fold lines 14, too, rest against the intermediate shaping mandrel 3 and no longer form edges.

Here, the sealing means 9 is in the form of a conventional rolling means. In addition to a holder not visible in FIG. 4 and intended for the first end element 4, the rolling means has two pairs 10 of rollers, of which only the pair of rollers which presses from outside against the end piece 4 is visible. The now cylindrical can sleeve 2 is inserted into the circular gap of the first end element 4. By turning the intermediate shaping mandrel 3 and the holder relative to the pairs 10 of rollers, the end element 4 is joined to the can sleeve 2 with a tight seal. The can sleeve 2 now joined at one end to the first end element 4 can now be pulled off again from the sealing means 9.

Figure 5:
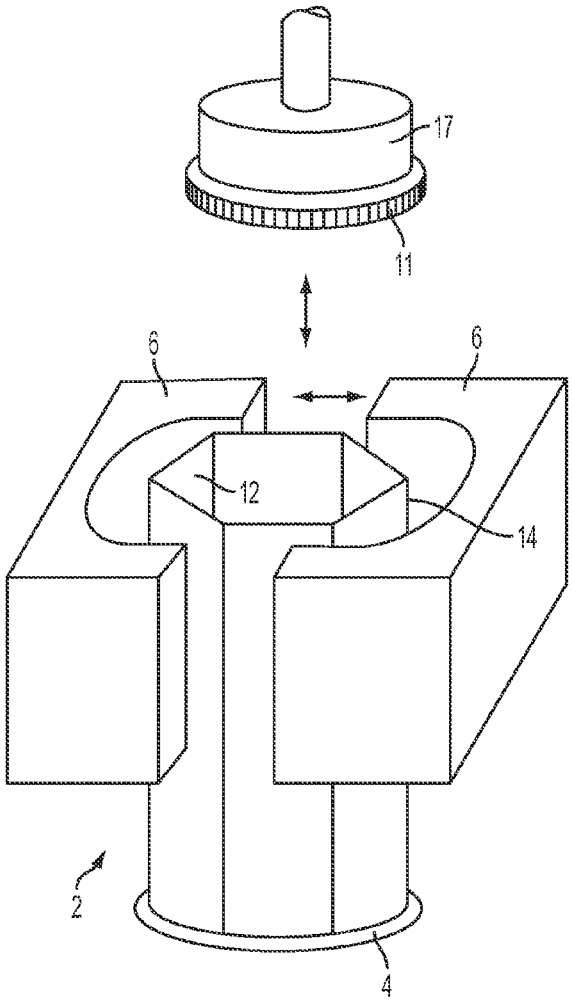
FIG. 5 shows a sheet-like sealing element above the can sleeve positioned between two intermediate shaping jaws, in oblique view.

FIG. 5 shows the can sleeve 2 which is joined at one end to the first end element 4 and is positioned at the other end between two intermediate shaping jaws 6, under an expanding punch 17 known per se. Here, the expanding punch 17 is equipped with a sealing element 11—for example in the form of an aluminium membrane.

After the can has been filled, the can sleeve 2 is converted into an intermediate cylindrical shape at the other end in a region adjacent to the internal opening by moving together the two intermediate shaping jaws 6. Thereafter, the sealing element 11 is inserted into the region by means of the expanding punch 17 and is heat-sealed tightly to the inner surface 12 of the can sleeve 2.

Figure 6:
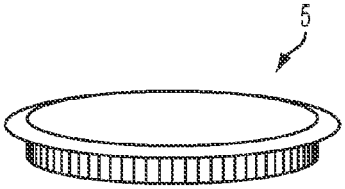
FIG. 6 shows a second end element.

FIG. 6 shows a second end element 5 in the form of an inserted lid. The inserted lid can be mounted at the other end, for example after the heat-sealing of the sealing element 11 on the can sleeve 2. The intermediate shaping jaws 6 can optionally have been removed again from the can sleeve 2 since the sealed sealing element 11 is sufficient to produce a circular cross-sectional area of the can sleeve 2. The imposing of the circular cross-sectional area can be supported by an inserted lid.

The can which has now been filled and provided with both end elements 4 and 5 has, with the exception of the two end regions of the can sleeve 2, one edge each along the six fold lines 14, the contour of which edge becomes steadily more pronounced towards the central region. Here, the can sleeve has a hexagonal cross-sectional area of the central region. In the central region of the can sleeve 2—i.e. in the region in which as a rule it is also gripped—the can according to the invention therefore also has the maximum stability of grip.

Figure 7:
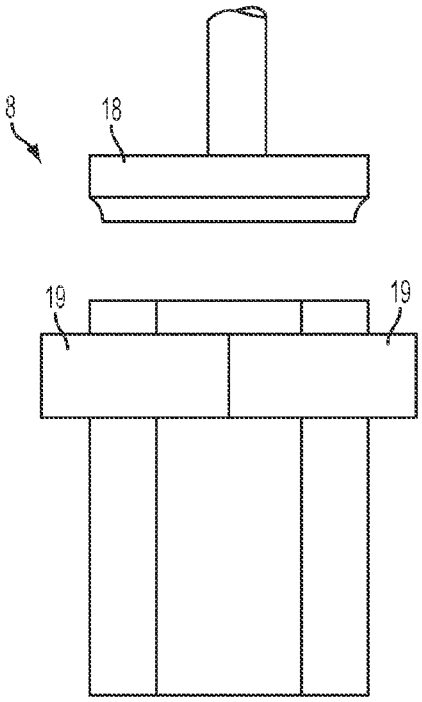
FIG. 7 shows a can sleeve kept circular by a flange shaping device, in side view.

FIG. 7 shows an alternative processing step which is carried out at the other end on the can sleeve 2. The can sleeve 2 is provided with a circular flange by a flange shaping means 8 which has a shaping punch 18 and two counterparts 19. The flange shaping means 8 can be heated in a manner known per se.

FIGS. 8 to 11 show force-displacement diagrams under external compressive load, perpendicular to the can axis, on cardboard cans of 73 mm diameter and 120 mm height, with a wall thickness of the cardboard sleeve of 0.4 mm and a fold radius of 2 mm. In each case, the force F in Newton is plotted along the ordinate and the indentation depth s in mm is plotted along the abscissa. The curves are denoted in each case by numbers from 2 to 10, indicating the number of fold lines (edges).

Figure 8:
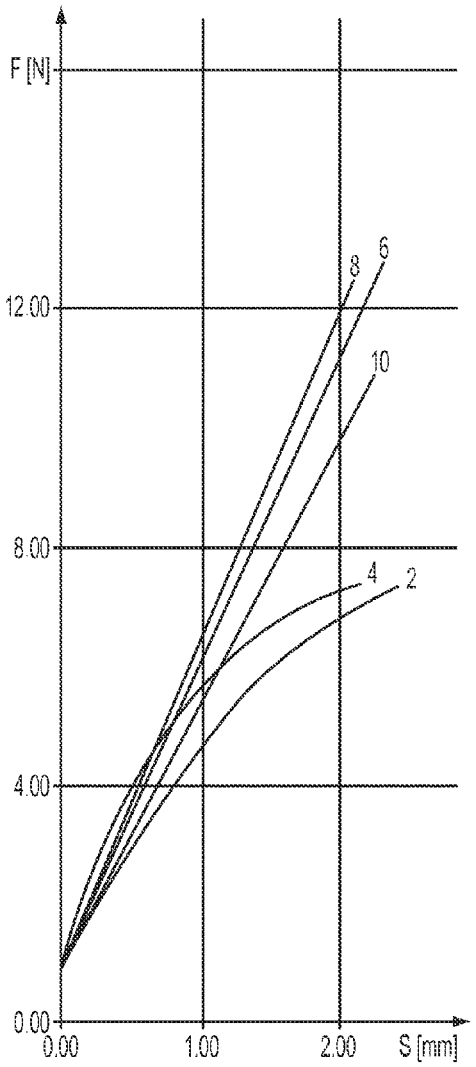
FIGS. 8 to 11 show force-displacement curves for the pressure on can sleeves having a polygonal cross-section.
Figure 9:
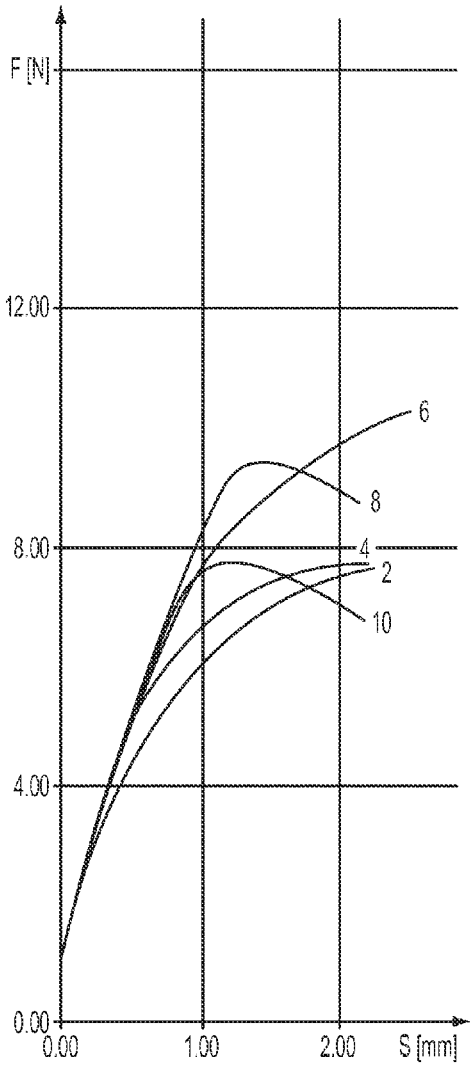

In FIGS. 8 and 9, the curves of the mean values of in each case 8 measurements of the pressure on the can at the height in the middle of the can are plotted, in particular in each case on the edge in FIG. 8 and in the middle of the respective prism surfaces in FIG. 9. Pressure was applied using a punch of 20 mm diameter, starting from an initial pressure of 1 N. It is found that hexagonal and octagonal can sleeves show by far the greatest resistance to deformation; in contrast, decagonal can sleeves on the one hand and biangular or tetragonal can sleeves on the other hand, which in each case already have a greater resemblance to a cylindrical can sleeve, retract to a considerable extent.

Figure 10:
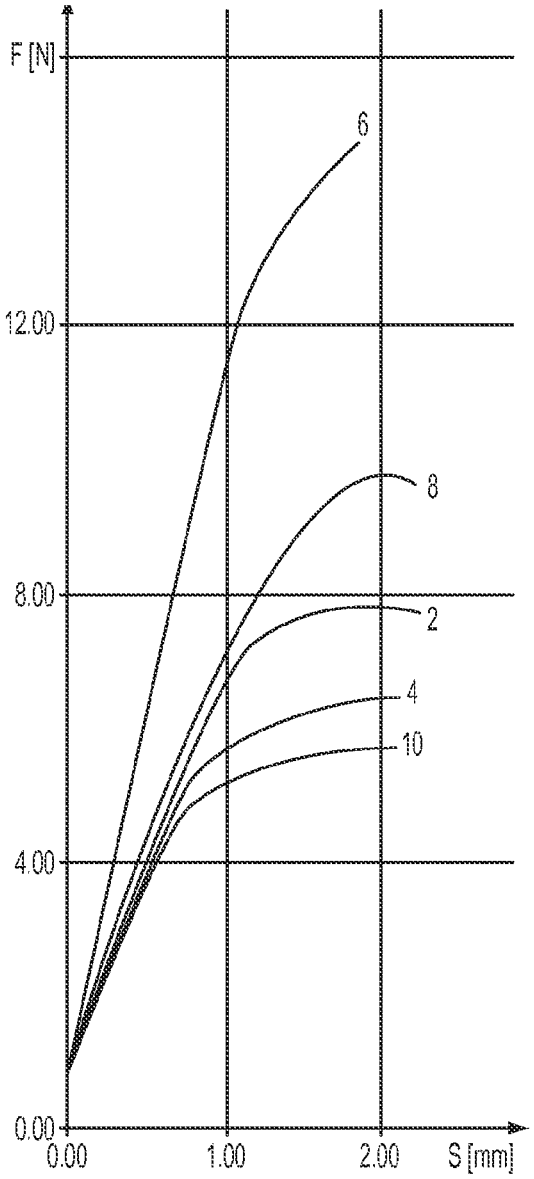
Figure 11:
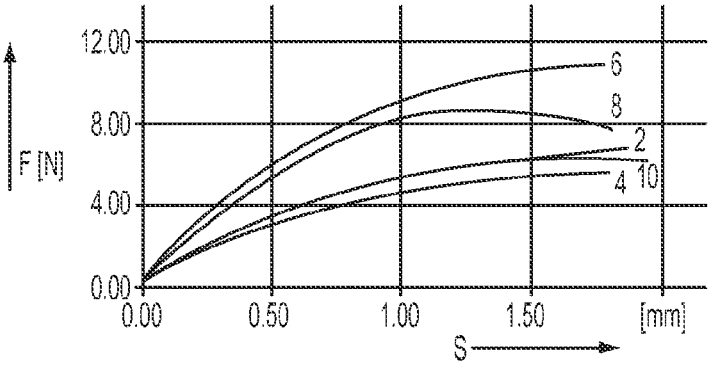

A similar result is obtained if—as shown in FIG. 10—the values of the pressure on the edge are measured at ¼ or at ¾ of the can height or if—as shown in FIG. 11—the values of the pressure on the middle of the edges are measured using a punch of 10 mm diameter and have an initial pressure of only 0.1 N.

The values are further improved if the can sleeve has an internal circumference which is 0.5 to 1 mm smaller than the lid circumference coming into contact with it, since the can sleeve then has to be expanded slightly at its opening and is prestressed thereby.

The invention claimed is:

1. A method for producing a can with fold lines, comprising steps of:

providing a can sleeve having edges parallel to a longitudinal can axis;

closing the can sleeve all round into a polygonally prefolded form having a first and second opening;

bringing said first opening into a circular shape with a circular first end element; and after the can is filled, bringing said second opening into a circular shape with a circular second end element;

wherein the polygonally prefolded form defines a polygon in a cross-section perpendicular to the longitudinal can axis, the polygon having ten or fewer sides;

wherein the circular shape of said first and second openings is achieved by at least one of drawing the can sleeve onto a cylindrical intermediate shaping mandrel or by applying at least two intermediate shaping jaws from outside.

2. The method according to claim 1, further comprising a step of preforming with a preforming means at least one of the first and second openings so that the can is preshaped.

3. The method of claim 2, wherein the preforming means is an intermediate shaping mandrel.

4. The method of claim 2, wherein the step of preforming with a preforming means at least one of the first and second openings, is such that the can is preflanged.

5. The method according to claim 1, wherein at least one of the first or second end element is joined to the first or second opening with a tight seal, by at least one of a first or second sealing means.

6. The method according to claim 5, wherein at least one of the first or the second sealing means is pressed in a radial direction against an inside and outside of the first or of the second end element.

7. The method of claim 5, wherein the at least one of the first or second end element is rolled, flanged or sealed.

8. The method according to claim 1, further comprising a step of, tightly joining a sheet-like sealing element to an inside of one of two end regions of the can sleeve.

9. The method of claim 8 wherein step of tightly joining is accomplished by heat-sealing or adhesively bonding.

10. The method of claim 1, wherein said sealing element is sealed or adhesively bonded to an inside of said can sleeve.

11. The method of claim 1, said polygon is a hexagon or an octagon.

* * * * *